US009242138B2

(12) United States Patent
Mukenev

(10) Patent No.: US 9,242,138 B2
(45) Date of Patent: Jan. 26, 2016

(54) MULTIFUNCTIONAL ELLIPTICAL TRAINER

(71) Applicant: Erzhan Karymgazyuly Mukenev, Almaty (KZ)

(72) Inventor: Erzhan Karymgazyuly Mukenev, Almaty (KZ)

( * ) Notice: Subject to any disclaimer, the term of this patent is extended or adjusted under 35 U.S.C. 154(b) by 0 days.

(21) Appl. No.: 14/406,248

(22) PCT Filed: Jun. 5, 2013

(86) PCT No.: PCT/IB2013/001889

§ 371 (c)(1),
(2) Date: Dec. 8, 2014

(87) PCT Pub. No.: WO2014/016680

PCT Pub. Date: Jan. 30, 2014

(65) Prior Publication Data

US 2015/0165264 A1 Jun. 18, 2015

(30) Foreign Application Priority Data

Jul. 25, 2012 (RU) ..... 2012131884

(51) Int. Cl.

| | |
|---|---|
| ***A63B 22/00*** | (2006.01) |
| ***A63B 22/06*** | (2006.01) |
| ***A63B 22/20*** | (2006.01) |
| ***A63B 22/04*** | (2006.01) |
| *A63B 23/04* | (2006.01) |

(52) U.S. Cl.

CPC ..... *A63B 22/0664* (2013.01); *A63B 22/001* (2013.01); *A63B 22/0046* (2013.01); *A63B 22/04* (2013.01); *A63B 22/203* (2013.01); *A63B 23/0488* (2013.01); *A63B 2022/003* (2013.01); *A63B 2022/0676* (2013.01)

(58) Field of Classification Search

USPC ..... 482/1–148

See application file for complete search history.

(56) References Cited

U.S. PATENT DOCUMENTS

| | | | | | |
|---|---|---|---|---|---|
| 4,973,046 | A * | 11/1990 | Maxwell | | 482/60 |
| 5,242,343 | A | 9/1993 | Miller | | |
| 5,807,210 | A * | 9/1998 | Devlin | | 482/52 |
| 6,117,052 | A * | 9/2000 | Frost | A63B 22/0056 | 482/52 |
| 6,220,990 | B1 * | 4/2001 | Crivello | A63B 21/068 | 482/148 |
| 6,921,353 | B2 * | 7/2005 | Chuang | | 482/52 |
| 6,997,854 | B2 * | 2/2006 | Yang | | 482/53 |
| 7,025,710 | B2 | 4/2006 | Corbalis et al. | | |
| 7,115,073 | B2 * | 10/2006 | Nizamuddin | | 482/51 |
| 8,167,778 | B2 * | 5/2012 | Lai | | 482/51 |
| 8,893,581 | B2 * | 11/2014 | White | | 74/594.7 |
| 2007/0184937 | A1 | 8/2007 | Graber | | |
| 2011/0071005 | A1 | 3/2011 | Lai | | |

FOREIGN PATENT DOCUMENTS

RU 2343946 C2 1/2007

* cited by examiner

*Primary Examiner* — Stephen Crow
(74) *Attorney, Agent, or Firm* — Nadya Reingand

(57) ABSTRACT

A multifunctional elliptical trainer equipped with steps that have an increased size transverse to the motion trajectory thereof, allowing the foot of the user to be positioned perpendicular to the motion trajectory of said steps, wherein the steps can have an increased length allowing the user to take a wide stance for side-step movement, or normal size steps which can be rotated and repositioned to achieve the same result. In addition to imitating forward walking, the invention allows the user to do the following exercises: Lunges, side steps and crossover side steps, thus training the inner and outer leg muscles.

3 Claims, 3 Drawing Sheets

MULTIFUNCTIONAL ELLIPTICAL TRAINER

CROSS REFERENCE TO RELATED APPLICATIONS

This patent application is a National stage application from PCT application No. PCT/IB2013/001889 filed on Jul. 5, 2013, which claims priority to Russian patent application RU2012131884 filed Jul. 25, 2012.

BACKGROUND OF THE INVENTION

1. Field of the Invention

The invention is in the field of sport and medicine, in particular exercise devices, more exactly—cardiovascular machines.

2. Background Art

There exists an elliptical exercise device in the prior art that consists of movable steps or pedals, which move along a closed curve. The exercise device contains a crank gear, installed on the foundation and connecting the rods, which support the steps or pedals. The ends of the rods opposite to the crank gear are provided with the rolls, and they move back and forth along the horizontal or inclined guides; or the ends of the rods are hung and perform a jigging motion along an arc, the radius of which is the length of the pendant, when the crank gear is rotating. At the same time, the steps or pedals are moving along the closed curve, approximating an elliptical path.

Prior art patent U.S. Pat. No. 5,242,343 dd. Sep. 30, 1992 shows an exercise device that imitates feet movement, resembling the movement when training on a treadmill and on an exercise bicycle simultaneously. The feet of the user training on this exercise device are placed parallel to the plane of the closed curve, along which the steps or pedals are moving. The exercise device imitates bipedal locomotion and creates effective load on the front and back muscles of the legs, but it practically doesn't load (stress or exercise) internal and external muscles of the legs, which may be loaded when walking or running sideways and even better when walking or step touch running.

The steps or pedals of the exercise device are set longitudinally and have dimensions sufficient to put the foot lengthwise to the exercise device. The length of the steps or pedals exceeds a foot length of an adult more than enough, and the lateral dimension exceeds the foot width of an adult more than enough. The foot length of an adult man reaches 33 centimeters that corresponds to the 50th shoe size according to the European size chart. The human foot width is approximately 0.3-0.4 of the foot length and reaches 10-12 cm. The steps or pedals of elliptical exercise devices used nowadays have length within 35-45 cm and width of 15-20 cm. The minimal foot length of an adult woman is about 21-22 cm that corresponds to the 35th shoe size according to the European size chart. It means that even a petite woman with minimal shoe size can't comfortably and securely put the feet across the steps or pedals of the exercise device and perform "walking sideways" exercise, which loads the internal and external muscles of the legs. The steps or pedals of the elliptical exercise device move in antiphase, when the trajectories of the steps or pedals movement are identical and symmetrical towards the relative vertical longitudinal plane, located longitudinally in the middle of the exercise device. This trajectory imitates upright bipedal locomotion, it doesn't suit much to walking sideways and doesn't suit at all to touch step, as in this case the legs of the person move overlapping to the full length of the step or pedal. And the man, when walking sideways, performs overlapping of the legs at approximately 30-40% of the step or pedal length, and when performing the touch step, he joins one foot to another. To perform the touch step, it is necessary for the trajectories of the feet movement to be distributed along the length of the exercise device and not to coincide with the length of the exercise device step or pedal plus the width of two steps or pedals with sufficient gap between them. Apart from that, the steps or pedals of the elliptical exercise device are separated to the width suitable for the right position of the feet in bipedal locomotion, approximately at 25-30 cm, and when performing the touch step, the feet of a person move in one and the same plane.

SUMMARY OF THE INVENTION

To provide convenient and safe performing of the exercises imitating walking sideways or step touch, and getting effective load on (stress or exercise of) internal and external muscles of the legs, the construction of the exercise device needs to be modified in the following ways:

1. The steps or pedals size, that is transversal to the movement plane, should be sufficient for a man to put his foot across the step or pedal movement plane.

2. Movement trajectories of the steps or pedals should be distributed along the exercise device length to the exercise device step or pedal length plus the width of two steps or pedals with a gap between them.

3. The steps or pedals should be located in such way that the person could step on the steps or pedals across the exercise device and put his feet parallel in one plane.

To broaden the potential of the elliptical exercise device, by means of creating a wider range of loads on the muscles of the legs, in particular, by adding the functions "walking sideways" and "step touch" for loading (stressing or exercising) the internal and external muscles of the legs, an elliptical exercise device is suggested, that is provided with the steps or pedals with the size transverse to the movement trajectory, which lets the user to put the foot across the step movement trajectory, when the steps or pedals may have an increased length, which lets the user to straddle his legs for performing step touch; or the steps of a common size can be turnable or relocatable to achieve this result.

Thus, the exercise device can be embodied in two variants:

Variant 1. Simplified. Elliptical exercise device is provided with the steps or pedals, which have the lateral size exceeding the foot length of an adult, and their length exceeds the exercise device step or pedal length. This variant lets the user, apart from performing bipedal locomotion, to perform walking with lunge on one of the legs, walking sideways and imitating step touch, but with the lunging one of the feet forward.

Variant 2. Elliptical exercise device is provided with the steps or pedals, which are installed with the possibility to be turned and relocated to different sides along the length of the exercise device. In such variant the exercise device lets the user to perform, apart from usual bipedal locomotion, walking with lunge on one of the legs, walking sideways, imitating step touch.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

The invention can be embodied on the elliptical exercise device, both with rear drive and forward drive, both with hung rods and ending rolls, which run along the guides. Elliptical exercise device with the front drive, provided with the rods, ending rolls, running along the guides, is suitable for embodiment of the invention with minimal changes in its structure. That's why a front-wheel drive elliptical exercise device is chosen for consideration the variants of possible invention embodiment on the drawings.

Figure 1:
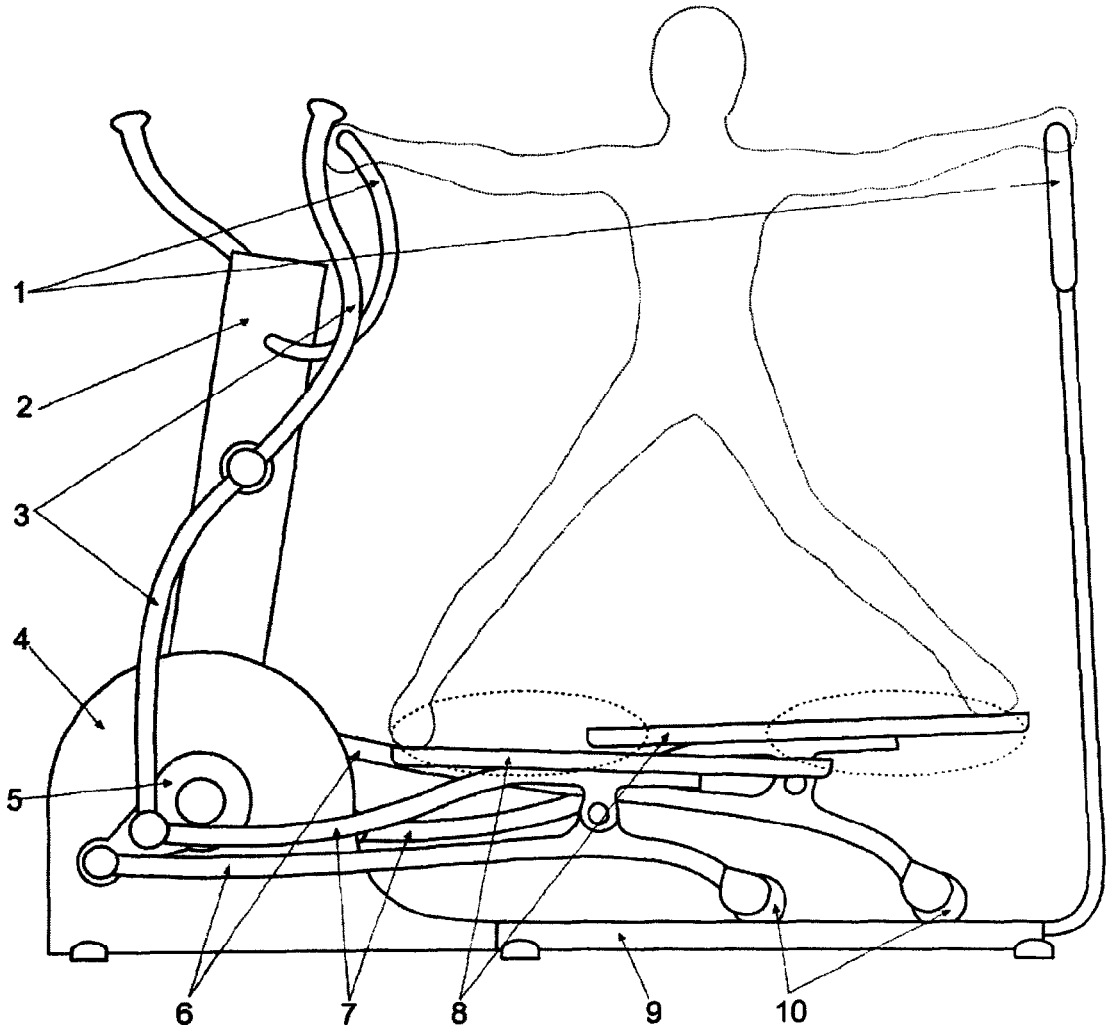
FIG. 1 shows an elevation view of a first variant.
Figure 2:
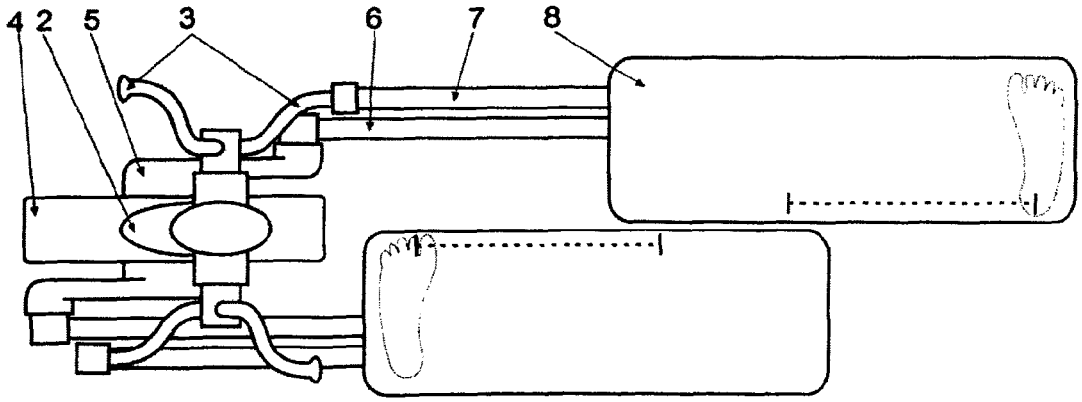
FIG. 2 shows a top view of a first variant.
Figure 3:
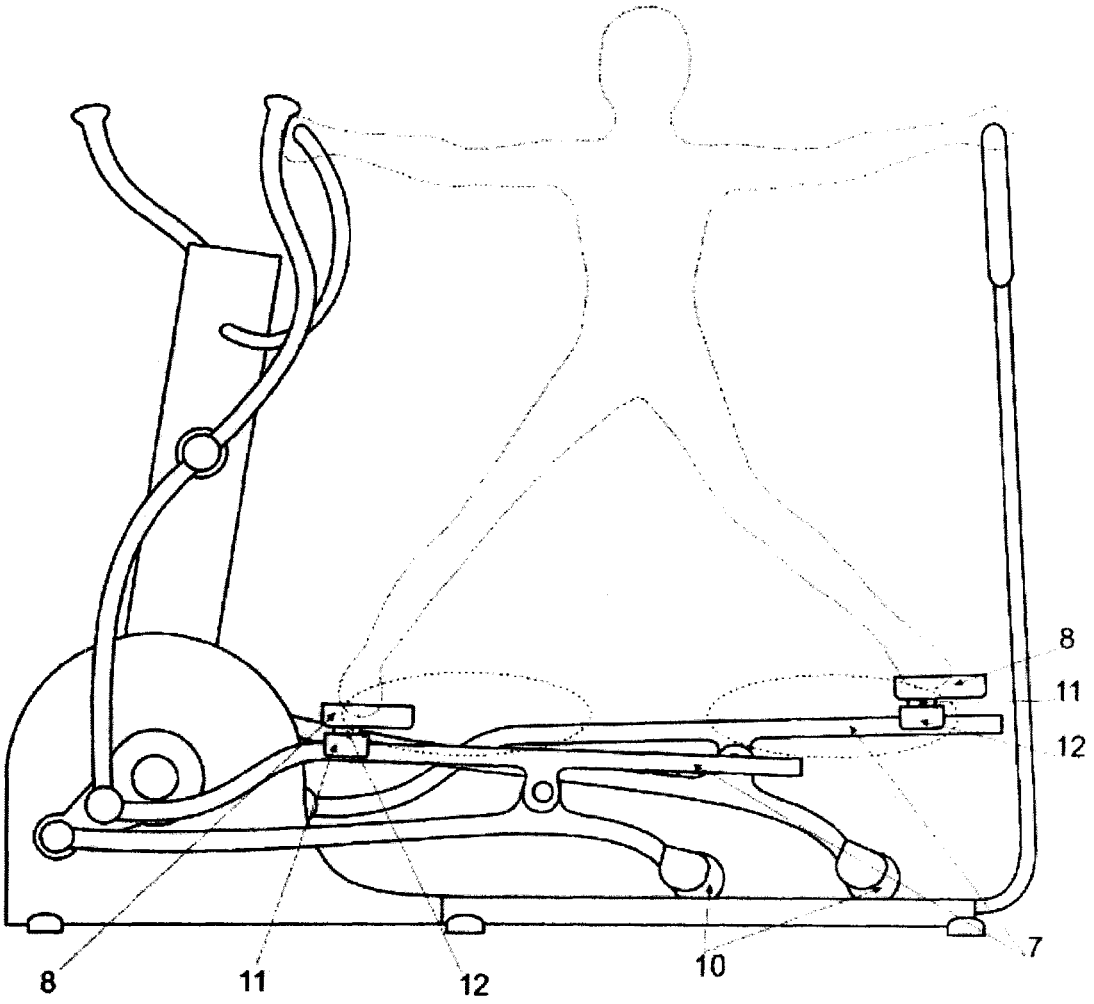
FIG. 3 shows an elevation view of a second variant.
Figure 4:
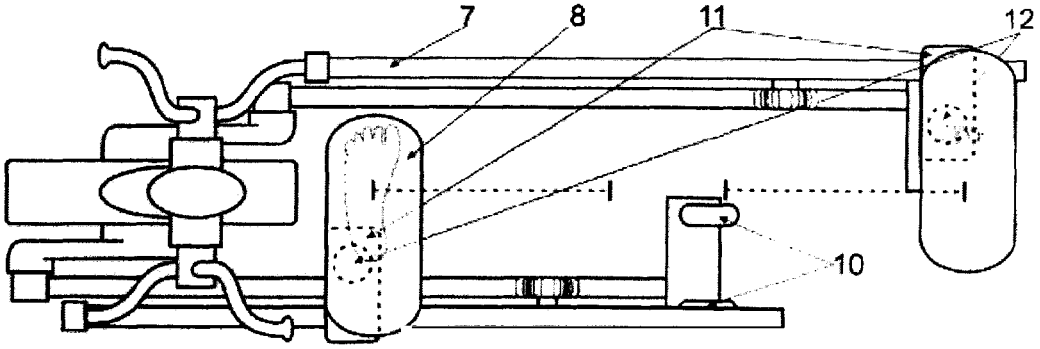
FIG. 4 shows a top view of a second variant.

FIGS. 1-2. Variant 1. Front-wheel drive elliptical exercise device contains frame 4, where a crank gear 5 is installed, articulated with the rods 6, the ends of which are provided with the rolls 10, which run back and forth along the guides 9. The pivots of the rods 6 have levers 7 pivotally mounted, where there are fixed steps or pedals 8, which have enlarged width, which lets the user (the user is depicted with a dashed line) to put the foot across the step or pedal. The steps or pedals also have enlarged length, exceeding the length of the exercise device step or pedal (the exercise device step or pedal length relative to each step or pedal is shown with a dashed line on FIG. 2), which lets the user to perform the movement imitating step touch with lunge (the feet movement trajectories are depicted with a dashed line on the FIG. 1). The levers 7 are articulated with swinging levers—handles 3, installed on the bar 2. The exercise device is provided with immovable handles 1 to support the user when performing exercises "walking sideways" or "step touch". The user is depicted, performing the exercise "step touch with lunge". It is clear that such construction of the steps also lets the user to perform, depending on the feet position, usual elliptical exercises like bipedal locomotion, walking with lunge on this or that leg, and walking sideways with overlapping.

Figure 5:
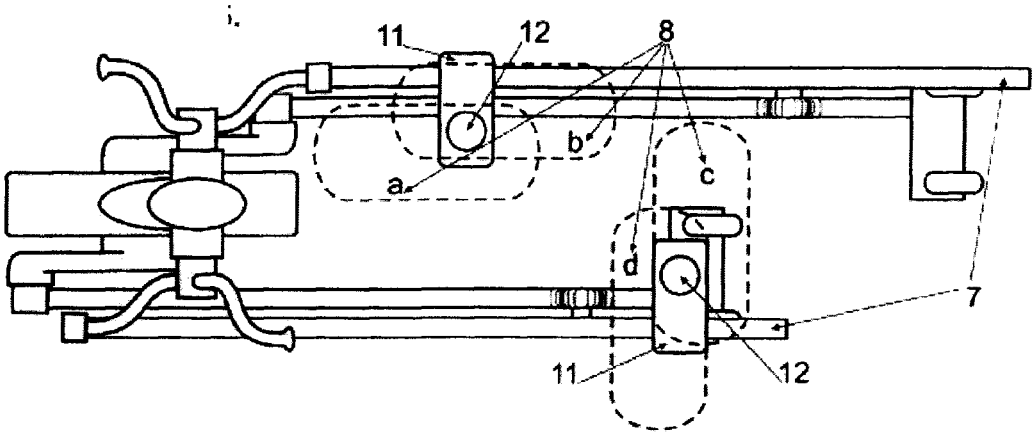
FIG. 5 shows roll guides and stationary handles.
Figure 6:
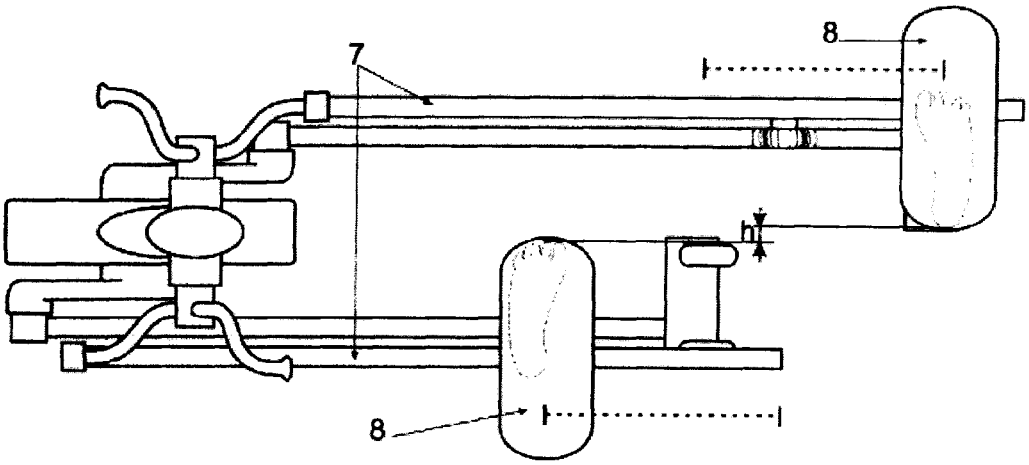
FIG. 6 shows roll guides and stationary handles.
Figure 7:
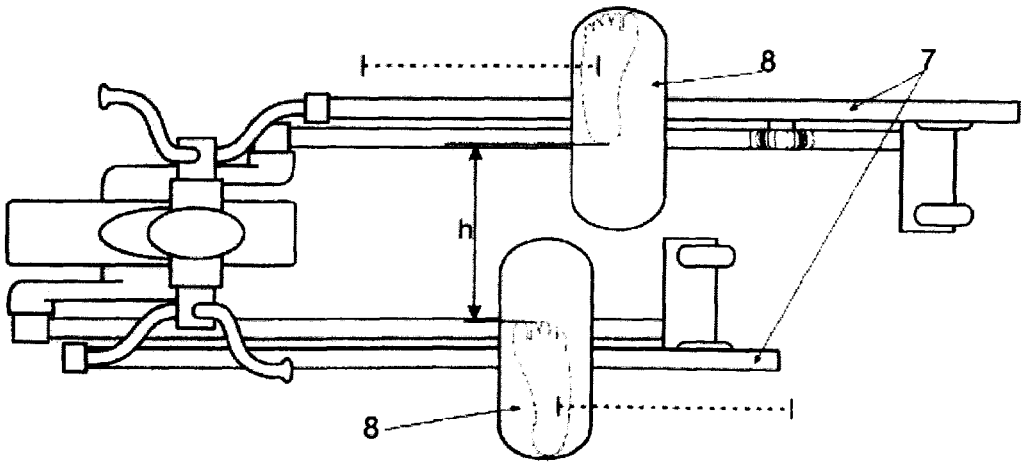
FIG. 7 shows roll guides and stationary handles.

FIGS. 3-7. Variant 2. The difference of this exercise device from the previous is that levers 7 have straight sections of guides with the length, exceeding the exercise device step or pedal by the width of the two steps or pedals and providing sufficient gap between them (the step or pedal of the exercise device is depicted with a dashed line). On these straight sections of guides of levers 7 there are installed carriages 11, which may be moved and fixed in a place needed, and steps or pedals 8 are installed on the carriages by means of fixed joint 12. The body of the joint 12 is attached to the step or pedal 8 and may rotate and fix in the joint fixture 12, which is set in the carriage 11. The fixed joint 12 may be cylindrical or ball-type. When the joint is of ball type, apart from turning the steps or pedals 8, the user will be able to adjust the steps or pedals pitch 8. The FIG. 5 shows four main positions: a,b,c,d, in which steps or pedals 8 can be fixed in relation to carriages 11 for performing different exercises. Positions a-b: the user can perform bipedal locomotion along elliptical trajectory with minimal—a—and enlarged —b—distance between the feet. When sliding carriages 11 apart to the opposite ends of the straight parts of guides of lever 7 the user can perform walking with lunge on left or right leg, depending on which of the carriages 11 (left or right) is fixed in front. Position c: the user can perform the exercise, imitating step touch with parallel feet position in one plane, FIGS. 3-4.

Position d: the user can perform step touch with feet overlapping. At the same time, the user can perform minimal foot lunge, the minimal distance h between the feet is shown on FIG. 6; also he can increase the foot lunge, the increased distance h between the feet is shown on FIG. 7, thus the user gets different load.

The invention claimed is:

1. A multifunctional elliptical exercise device, comprising: movable pedals kinematically connected with a crank gear, moving along a closed curve, approximating an elliptical path, with dimensions that enable a user to put his or her feet parallel to a movement trajectory, wherein the pedals are turnably connected such that they may rotate up to 90 degrees to perform "walking sideways" exercises; and a fixable ball-type joint connected to said pedals for fixing and rotating said pedals.

2. The exercise device according to claim 1, further comprising guide levers, said turnable pedals are relocatable along a length of said guide levers.

3. The exercise device according to claim 1, wherein the pedals are at least 33 cm wide.

* * * * *